US007040915B1

(12) United States Patent
Pollack

(10) Patent No.: US 7,040,915 B1
(45) Date of Patent: May 9, 2006

(54) INSULATION DISPLACEMENT ELECTRICAL PLUG ASSEMBLY AND METHOD OF MAKING PLUG ASSEMBLY

(76) Inventor: George P. Pollack, P.O. Box 11831, Chicago, IL (US) 60611

( * ) Notice: Subject to any disclaimer, the term of this patent is extended or adjusted under 35 U.S.C. 154(b) by 349 days.

(21) Appl. No.: 09/587,948

(22) Filed: Jun. 6, 2000

(51) Int. Cl.
*H01R 4/24* (2006.01)
*H01R 4/26* (2006.01)
*H01R 11/20* (2006.01)

(52) U.S. Cl. ..... 439/424; 439/733.1; 439/660

(58) Field of Classification Search ..... 439/425, 439/426, 733.1, 442, 391, 421, 424, 660
See application file for complete search history.

(56) References Cited

U.S. PATENT DOCUMENTS

| | | | | | |
|---|---|---|---|---|---|
| 2,229,288 | A | | 1/1941 | Gilbert | 173/361 |
| 2,283,889 | A | | 5/1942 | Gilbert | 173/361 |
| 2,312,795 | A | | 3/1943 | Brownstein | 173/361 |
| 2,511,806 | A | | 6/1950 | Macy | 173/361 |
| 2,966,651 | A | | 12/1960 | Von Holtz | 339/41 |
| 2,982,938 | A | * | 5/1961 | Klumpp, Jr. | 439/424 |
| 3,134,632 | A | | 5/1964 | Kimball et al. | 339/195 |
| 3,248,686 | A | | 4/1966 | Ruehlemann | 339/213 |
| 3,400,360 | A | | 9/1968 | Schmitt et al. | 339/64 |
| 4,792,309 | A | | 12/1988 | Chu | 439/695 |
| 5,567,187 | A | | 10/1996 | Bellinger | 439/877 |
| 6,045,408 | A | * | 4/2000 | Takemasa | 439/733.1 |

FOREIGN PATENT DOCUMENTS

| | | | | |
|---|---|---|---|---|
| BE | 0544048 | * | 9/1959 | 439/425 |
| BE | 0622734 | * | 1/1963 | 439/425 |
| JP | 09-213436 | * | 8/1997 | |
| JP | 9-2213436 | * | 8/1997 | |

* cited by examiner

*Primary Examiner*—P. Austin Bradley
*Assistant Examiner*—F. O. Figueroa
(74) *Attorney, Agent, or Firm*—Gardner Carton & Douglas LLP

(57) ABSTRACT

An insulation displacement plug assembly includes a plug housing, a pair of insulated conductors and a pair of electrical terminals. Each electrical terminal includes a crimp flange, a pair of insulation piercing knives and a blade. The crimp flange has a pair of upwardly and outwardly flared opposite side portions and an arcuate-shaped bottom portion extending between and interconnecting the side portions. Each piercing knife is electrically connected to the crimp flange and is cutout and bent upwardly from the bottom portion of the crimp flange and disposed interiorly of the side portions of the crimp flange such that the end of an insulated conductor can be placed between the side portions of the crimp flange and over the piercing knives and the crimp flange crimped onto the insulated conductor end by bending the side portions of the crimp flange toward one another over and downwardly toward the insulated conductor end whereupon the side portions of the crimp flange press the insulated conductor end downwardly upon the piercing knife which pierces and displaces insulation of the insulated conductor end and makes a substantially gas-tight electrical connection with an electrical wire within the insulated conductor. The blade is connected to the crimp flange and extends therefrom for insertion into an external electrical socket for making an electrical connection with a contact thereof.

19 Claims, 4 Drawing Sheets

16
34
30
36
28
34

14
24
20
32
28
26
30
40

16A
32B
16C
32A
16D
16
38
40
28
10
34
30
36
34
16B
10
16D
32A
16C 32B
16A
32A
32
16D
16D
40
40
14A
28
30
36
11
16B
11
14
26
24

INSULATION DISPLACEMENT ELECTRICAL PLUG ASSEMBLY AND METHOD OF MAKING PLUG ASSEMBLY

BACKGROUND OF THE INVENTION

1. Field of the Invention

The present invention generally relates to plug assemblies and, more particularly, is concerned with an insulation displacement plug assembly and a method of making the assembly.

2. Description of the Prior Art

Dual blade plug assemblies have been used to make electrical connections for many years. These dual blade plug assemblies have either a polarized or non-polarized feature. The process of making a plug assembly can be a challenge. Several methods exist for manufacturing dual blade plug assemblies.

One method involves joining a pair of terminals and one plug housing in an assembly machine. Two wires, unstripped, are threaded through the plug housing prior to assembly. When the wires are located properly in the assembly nest with the plug housing, a machine inserts the two terminals into the plug housing. During the insertion process, the back sides of the terminals scrape the insulation from the two wires. The terminals rest against the exposed conductors of the wires and thereby create an electrical connection.

Another method involves inserting a pair of metal terminals into a plastic plug housing. The plug housing's top portion is hinged. Two wires, unstripped, are threaded into the open plug housing and placed across sharp portions formed on the metal terminals. The hinged portion of the plug housing is then closed. During this process, the hinged portion of the plug housing presses the unstripped wires onto the sharp portions of the terminals. These sharp portions pierce the insulation making contact with the conductors of the wires. The hinged portion of the terminal acts as a strain relief holding the insulated wire in place.

Still another method involves first stripping insulation away from the wires to expose their conductor portions. Terminal blades are then mechanically crimped onto the stripped conductor portions of the wires and may be soldered. The wires with the terminals attached are inserted into a molding machine. The machine closes the mold tool onto the wires and terminals, injects molten plastic to form the plug housing and keeps the wires, terminals and molten plastic enclosed in the mold tool until cool. The machine then opens, releasing the wires mechanically crimped onto the terminals and permanently encased in a solidified plastic plug housing.

Yet another method involves first stripping insulation away from the wires and then threading the stripped wires through the back of a plug assembly. The bare conductors of the wires are attached to the terminals by threaded fasteners. The terminals are pressed into a plastic or phenolic plate that is part of the plug assembly. The wires are pulled back through the plug assembly and a cover plate is attached to the face of the plug assembly, protecting the consumer from the bare electrical wires underneath.

While these and other prior art methods for making dual blade plug assemblies appear to be satisfactory, none of them alone combines efficiency and reliability without incurring substantial costs in both equipment and labor. Consequently, a need still remains for a plug assembly and method of making the assembly which provides an optimum solution to the aforementioned problem in the prior art without introducing any new problems in place thereof.

SUMMARY OF THE INVENTION

The present invention provides an insulation displacement plug assembly and a method of making the assembly designed to satisfy the aforementioned need. The insulation displacement plug assembly of the present invention can be manufactured in large quantities with efficiency, reliability and relatively low cost. Either polarized or non-polarized dual blade plug assemblies can be made which are permanent, have a reliable connection and are safe for all consumers to use in their homes and places of business.

Accordingly, the present invention is directed to an electrical terminal which comprises: (a) a crimp flange having a pair of upwardly and outwardly flared opposite side portions and an arcuate-shaped bottom portion extending between and interconnecting the side portions; (b) at least one insulation piercing knife connected to the crimp flange and being cutout and bent upwardly from the bottom portion and disposed interiorly of the side portions thereof such that an end of an insulated conductor can be placed between the side portions of the crimp flange and over the piercing knife and the crimp flange crimped onto the insulated conductor end by bending the side portions of the crimp flange toward one another over and downwardly toward the insulated conductor end whereupon the side portions of the crimp flange press the insulated conductor end downwardly upon the piercing knife which pierces and displaces the insulation of the insulated conductor end and makes a substantially gas-tight electrical connection with an electrical wire within the insulated conductor; and (c) a blade connected to the crimp flange and extending therefrom for insertion into an external electrical socket for making an electrical connection with a contact thereof.

More particularly, the electrical terminal preferably includes a pair of insulation piercing knives cutout and bent upwardly from the bottom portion and disposed interiorly of the side portions thereof and substantially in an end-to-end alignment with one another. The blade of the electrical terminal further includes a web portion connected to the crimp flange and having a plurality of undulations formed along opposite sides of the web portion so as to define lance-formed barbs which are capable of abutting against a plug housing and preventing removal of the electrical terminal therefrom.

The present invention is also directed to an electrical plug assembly which comprises: (a) a plug housing having opposite ends and defining a pair of spaced apart channels therethrough open at each of the opposite ends thereof; (b) a pair of insulated electrical conductors each having an end and an electrical wire and being disposed at least partially within one of the channels of the plug housing; and (c) a pair of electrical terminals each being insertable into one of the channels of the plug housing at one of the opposite ends of the plug housing. Each electrical terminal has the construction as defined above.

More particularly, the housing has a one-piece construction and each electrical terminal has a one-piece construction. The electrical terminal has opposite ends and the crimp flange of the electrical terminal is disposed at a rearward position on the electrical terminal adjacent to one of the opposite ends thereof. The blade of the electrical terminal is disposed at a forward position on the electrical terminal opposite from the crimp flange and adjacent to the other of the opposite ends of the electrical terminal and extending therefrom toward but spaced from the one opposite end of the electrical terminal.

The present invention is also directed to a method of making a plug assembly which comprises the steps of: (a) providing a plurality of electrical terminals on a strip; (b) passing a pair of insulated conductors through channels of at least one plug housing such that separate portions of each of the insulated conductors extend from opposite ends of the plug housing; (c) aligning ends of the electrical terminals with the portions of the insulated conductors which extend from one of the opposite ends of the plug housing; (d) removing the strip interconnecting the electrical terminals; (e) crimping the electrical terminals on the ends of the insulated conductors such that insulation on the insulated conductors is penetrated and electrical connections are made between the electrical terminals and electrical wires within the ends of the insulated conductors; and (f) securing the crimped electrical terminals on the insulated conductor ends within the channels of the plug housing. The method further includes removing the strip concurrently with crimping of the electrical terminal on the ends of the conductors.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIGS. 12 to 15 are a series of top plan views showing the steps involved in a method of making the plug assembly also of the present invention, wherein FIG. 12 shows a plurality of electrical terminals disposed side-by-side and interconnected by strips, FIG. 13 shows a pair of insulated conductors passed through a plurality of end-to-end arranged plug housings and a leading pair of the electrical terminals aligned with leading ends of insulated conductors forwardly of the leading one of the plug housings, FIG. 14 shows the pair of electrical terminals crimped on the ends of the insulated conductors, and FIG. 15 shows the assembly in an assembled condition as shown in FIG. 1 with the crimped terminals on the ends of the insulated conductors secured within the leading one of the plug housings after insertion therein through the front end thereof.

DETAILED DESCRIPTION OF THE INVENTION

Figure 1:
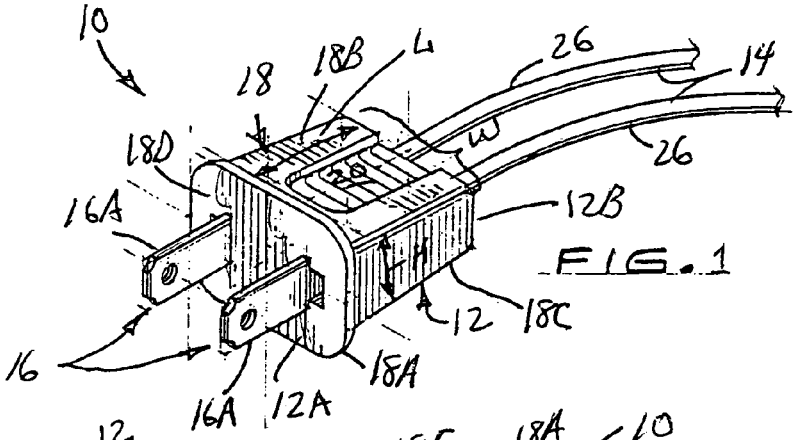
FIG. 1 is a perspective view of an insulation displacement plug assembly of the present invention.
Figure 2:
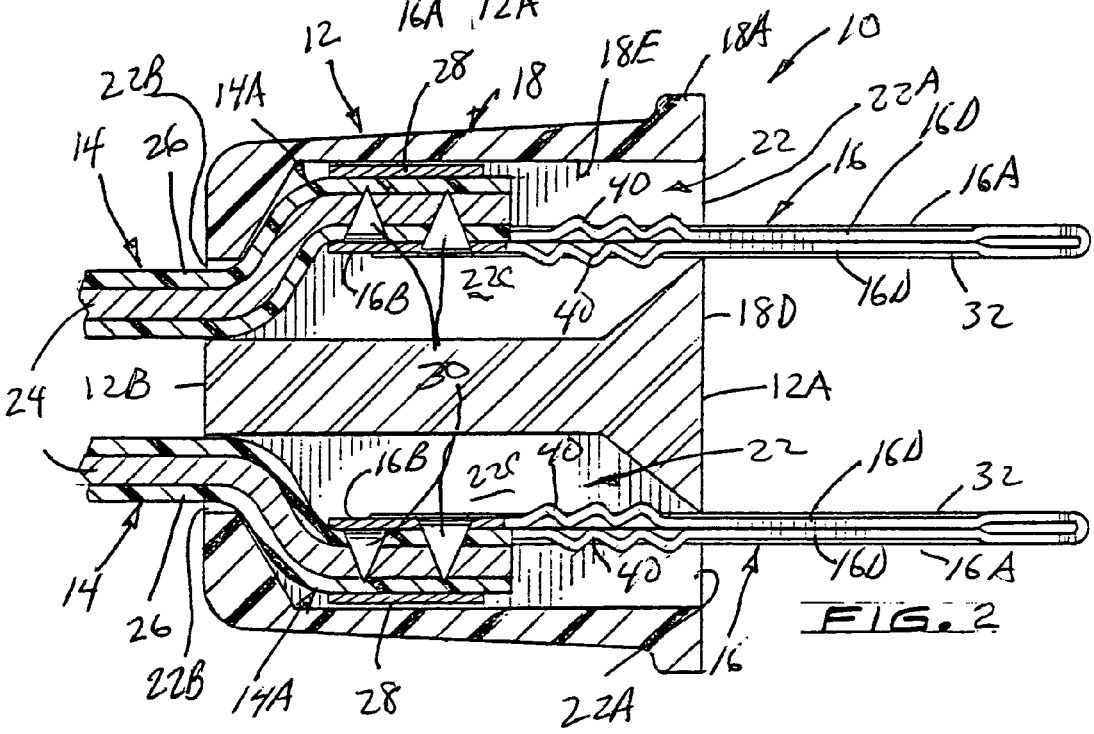
FIG. 2 is an enlarged view of the assembly of FIG. 1 with a plug housing and electrical conductors of the assembly shown in a transverse sectional form.
Figure 3:
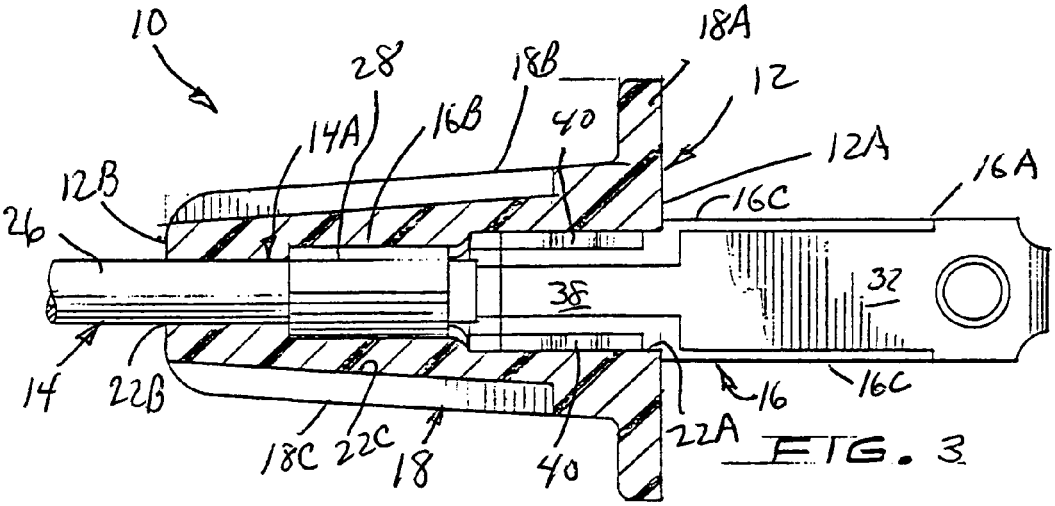
FIG. 3 is another enlarged sectional view of the assembly of FIG. 1 with the plug housing shown in a longitudinal sectional form.
Figure 4:
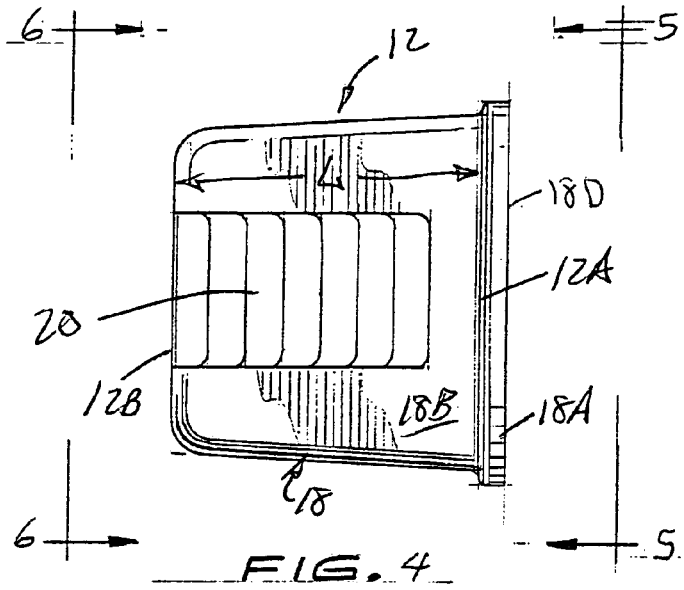
FIG. 4 is a top plan view of a plug housing of the assembly of FIG. 1.
Figure 5:
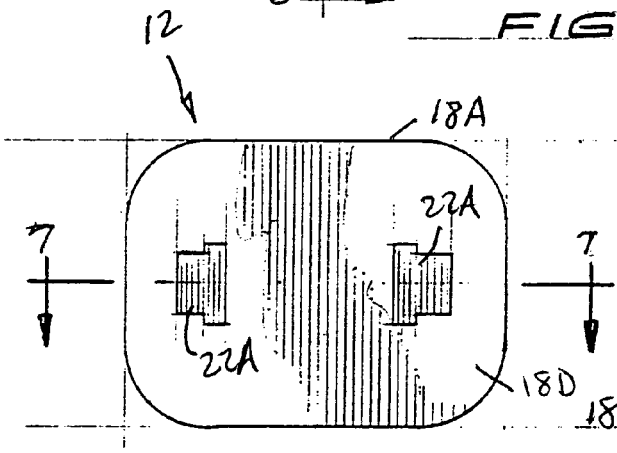
FIG. 5 is a front view of the plug housing as seen along line 5—5 of FIG. 4.
Figure 6:
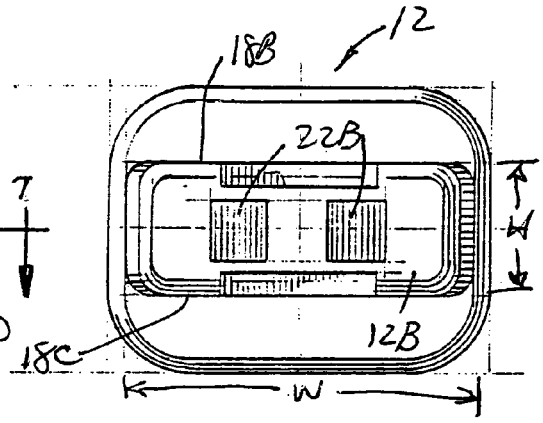
FIG. 6 is a rear view of the plug housing as seen along line 6—6 of FIG. 4.

Referring to the drawings and particularly to FIGS. 1 to 3, there is illustrated an insulation displacement plug assembly, generally designated 10, of the present invention. The insulation displacement plug assembly 10 basically includes a housing 12, a pair of insulated conductors 14 and a pair of electrical terminals 16, also being a feature of the present invention. The plug housing 12 is also shown in FIGS. 4 to 7. The electrical terminal 16 is also shown in FIGS. 8 to 11. Steps of a method of making the plug assembly 1.0, in accordance with the present invention, are shown in FIGS. 12 to 15.

Referring now to FIGS. 1 to 7, the plug housing 12 of the assembly 10 has a one-piece construction and can be made in any suitable manner, such as by employing conventional injection molding techniques. The plug housing 12 is comprised of any suitable non-conductive material, such as polypropylene plastic material. The plug housing 12 has a pair of opposite front and rear ends 12A, 12B and a main body 18 with a front end flange 18A attached about and protruding outwardly from the front end 12A of the plug housing 12. The main body 18 has a substantially rectangular configuration with rounded corners and tapers slightly from the front end 12A to the rear end 12B of the plug housing 12. The main body 18 has a length L, a width W and a height H. The length L and the width W of the main body 18 are approximately the same and are each greater than the height H of the main body 18, though the dimensions of the main body 18 need not be so limited. The main body 18 also has a series of recessed gripping elements 20 defined in opposite top and bottom surfaces 18B, 18C of the main body 18. The front end flange 18A has a substantially rectangular configuration with rounded corners. The main body 18 and front end flange 18A thereon define a substantially flat surface 18D at the front end 12A of the plug housing 12 serving as an electrical arcing protection device and for abutting flush against a face of a wall-mounted external electrical socket (not shown).

Figure 7:
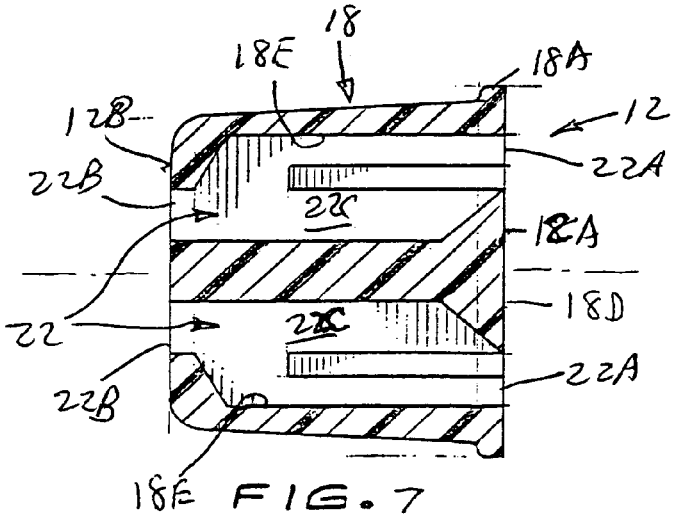
FIG. 7 is a transverse sectional view of the plug housing taken along line 7—7 of FIG. 5.

The plug housing 12 further defines a pair of spaced apart interior channels 22 extending therethrough between the opposite front and rear ends 12A, 12B of the plug housing 12. The channels 22 are substantially identical to and mirror images of one another. Each channel 22 has a front opening 22A at the front end 12A of the plug housing 12, a rear opening 22B at the rear end 12B of the plug housing 12, and a main channel portion 22C extending therebetween which is greater in cross-sectional size than each of the front and rear openings 22A, 22B. The front and rear openings 22A, 22B of each channel 22 also are offset with respect to one another relative to a longitudinal centerline LL of the plug housing 12, shown in FIG. 7. The front opening 22A has a generally T-shaped configuration and leads not only into the main channel portion 22C but also into opposing top and bottom recessed grooves formed in the interior wall surface 18E of the main body 18 of the plug housing 12. The opposing recessed grooves are substantially identical to one another and are continuous with and extend from the from opening 22A toward but terminate at ends spaced from the rear opening 22B, as seen in FIG. 7.

Figure 13:
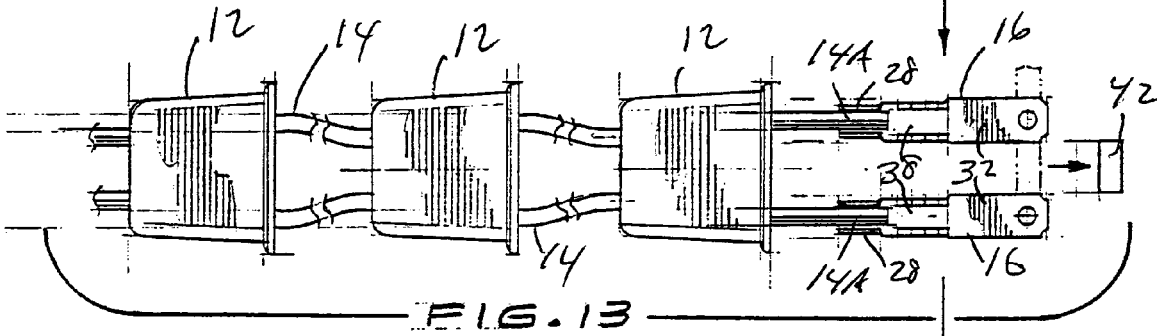
Figure 14:
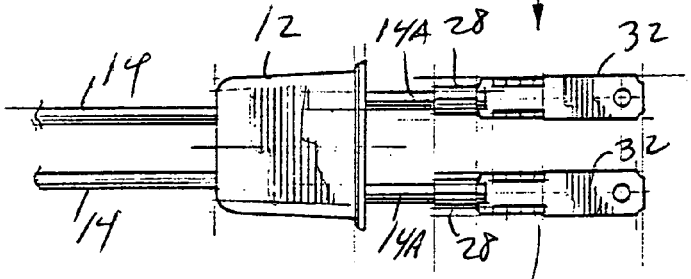

Referring now to FIGS. 2, 3, 9 and 11, each of the insulated conductors 14 has opposite ends 14A (only one being shown) and includes an inner electrical wire 24 made of a suitable conductive material, such as copper, and an outer layer of insulation 26 made of a suitable non-conductive material, such as a plastic material. The layer of insulation 26 completely surrounds and encloses the electrical wire 24. One end 14A of each of the insulated conductors 14 is disposed and extends partially within one of the channels 22 of the plug housing 12. As seen in FIGS. 13 and 14, each of the insulated conductors 14 extends entirely through a respective one of the channels 22 of the plug housing 12 during the process of assembling the plug assembly 10 but is disposed only partially through the respective one channel 22 of the plug housing 12 when the plug assembly 10 is in the assembled condition, as seen in FIGS. 1 to 3. The insulated conductors 14 are bent within the main channel portions 22C of the channels 22 of the plug housing 12 due to the front and rear openings 22A, 22B of the channels 22 being offset with respect to one another. The insulated conductors 14 can be of any suitable conventional type.

Figures 8, 9, 10, 11:
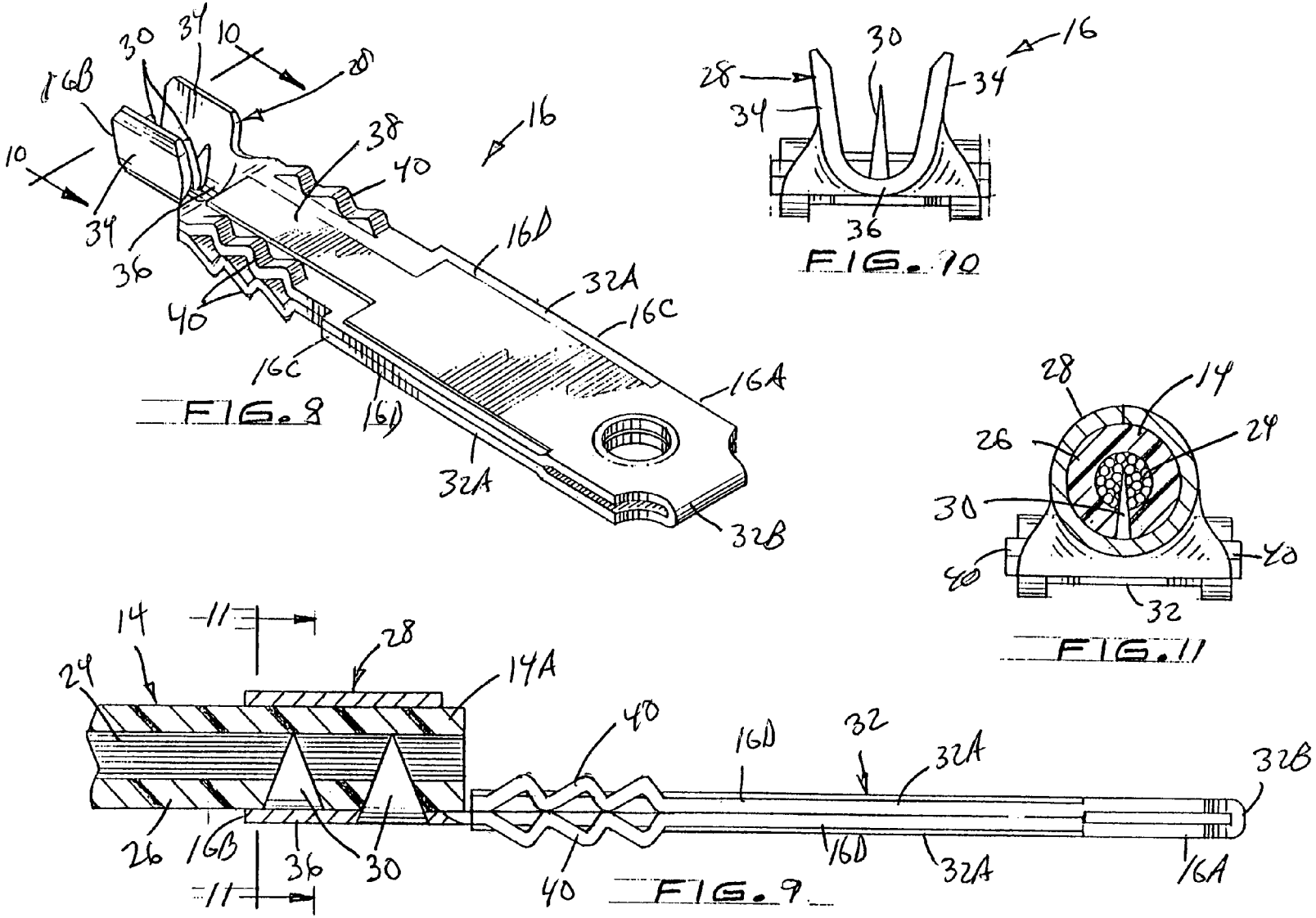
FIG. 8 is a perspective view of an electrical terminal of the assembly also of the present invention.
FIG. 9 is an enlarged view of the electrical terminal crimped onto an end of an insulated conductor shown in a longitudinal sectional form.
FIG. 10 is an enlarged end view of the electrical terminal as seen along line 10—10 of FIG. 8.
FIG. 11 is a transverse sectional view of the electrical terminal and the insulated conductor taken along line 11—11 of FIG. 9.

Referring now to FIGS. 1 to 3 and 8 to 15, each of the electrical terminals 16 has a one-piece construction and is made from a strip of an electrically conductive material which is substantially folded onto itself. Each electrical terminal 16 has opposite ends 16A, 16B, opposite side edges 16C and opposing layers 16D and includes a crimp flange 28, at least one and preferably a pair of insulation piercing knifes 30 and a blade 32, all of which are integrally connected together. The crimp flange 28 has a generally U-shaped configuration, as best seen in FIGS. 8 and 10. The crimp flange 28 has a pair of upwardly and outwardly flared opposite side portions 34 and an arcuate-shaped bottom portion 36 extending between and interconnecting the side portions 34. The crimp flange 28 is disposed at a rearward position on the electrical terminal 16 adjacent to the end 16B of the terminal 16.

The insulation piercing knifes 30 of each electrical terminal 16 are spaced apart from one another in a substantially end-to-end tandem aligned relationship. Each piercing knife 30 has a generally triangular configuration, as best seen in FIG. 9. Each piercing knife 30 is integrally connected to the crimp flange 28 and, more particularly, is cutout and bent upwardly from the bottom portion 36 and disposed interiorly of the side portions 34 thereof. The piercing knives 30 are centrally located between the side portions 34 of the crimp flange 28. The leading end 14A of one of the insulated conductors 14 can be placed between the side portions 34 of the crimp flange 28 and over the piercing knives 30 and the crimp flange 28 crimped onto the insulated conductor end 14A by bending the side portions 34 of the crimp flange 28, either manually by using a conventional crimping tool or mechanically by using suitable automated machinery, toward one another over and downwardly toward the insulated conductor end 14A whereupon the side portions 34 of the crimp flange 28 press the insulated conductor end 14A downwardly upon the piercing knifes 30 which pierce and displace the outer layer of insulation 26 of the insulated conductor end 14A and make a substantially gas-tight electrical connection with the inner electrical wire 24 within the insulated conductor 14, as best seen in FIGS. 9 and 11. After such crimping the crimp flange 28 of the electrical terminal 16 may be inserted into the channel 22 of the plug housing 12 at the front end 12A thereof rearwardly to a point spaced interiorly from the rear end 12B of the plug housing 12, as best seen in FIGS. 2 and 3.

The blade 32 of the electrical terminal 16 has a substantially elongated and flat configuration, as best seen in FIGS. 8 and 11. The blade 32 has a pair of opposing layers 32A and an end bight portion 32B. The opposing layers 32A are joined together at the end bight portion 32B. The opposing layers 32A are sandwiched against one another. The blade 32 is disposed at a forward position on the terminal 16 opposite from the crimp flange 28 and adjacent to the end 16A of the terminal 16 and extending from the end 16A toward but spaced from the end 16B of the terminal 16. The blade 32 is insertable into a conventional external electrical socket (not shown) for making an electrical connection with a contact of the external electrical socket.

The blade 32 also includes a web portion 38 connected to the arcuate-shaped bottom portion 36 of the crimp flange 28. The web portion 38 has a plurality of kinks or undulations 40 formed along opposite sides thereof so as to define lance-formed barbs 40 which are capable of abutting against the interior wall surface 18*e* of the main body 18 of the plug housing 12, as best seen in FIGS. 2 and 3, so as to prevent removal of the electrical terminal 16 therefrom by being pulled back from the channel 22 through the front end 12A of the plug housing 12. The lance-formed barbs 40 are in two sets along each side of the web portion 38, although they need not be so limited. Thus, the installation is permanent. The crimp flange 28, once crimped and in barrel-form, firmly holds the insulated conductor 14 and resists a pull of up to twenty pounds. The electrical terminals 16 require more than forty pounds of force to remove them from the plug housing 12 once assembled.

Figure 12:
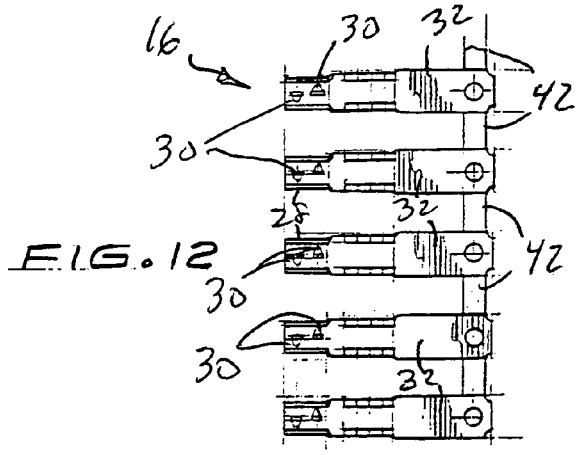
Figure 15:
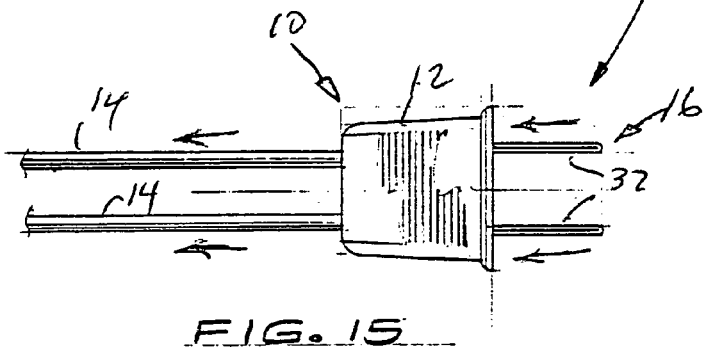

Referring now to FIGS. 12 to 15, there is illustrated the steps in the method of making the plug assembly 10. The method includes the step of providing the plurality of electrical terminals 16 in side-by-side relationship and interconnected at adjacent portions of their blades 32 by strips 2, as shown in FIG. 12. The method also includes the step of passing the pair of insulated conductors 14 through channels 22 of at least one and, preferably, a plurality of the plug housings 12, as shown in FIG. 13, such that separate portions of each of the insulated conductors 14 extend from opposite ends 12A, 12B of the plug housing 12. The method further includes the step of aligning ends of a leading pair of the electrical terminals 16 with the leading ends 14A of the insulated conductors 14, as shown in FIG. 13, which extend from the front end 12A of the plug housing 12. The method still further includes the step of crimping the electrical terminals 16 on the ends 14A of the insulated conductors 14, as seen in FIG. 14, such that the insulation 26 on the insulated conductors 14 is penetrated by the knives 30 and electrical connections are made between the electrical terminals 16 and electrical wires 24 within the ends 14A of the insulated conductors 14. The strips 42 interconnecting the leading terminals 16 can be removed, as seen in FIG. 13, either before or after or concurrently with the crimping step. The method includes the final step of securing the crimped pair of terminals 16 on the insulated conductor ends 16A within the channels 22 of the plug housing 12, as shown in FIG. 15. The strip 42 is of any suitable type which connects the terminals 16 to one another. An automated assembling process takes about 3.2 seconds to complete. Because the electrical wire 24 of the insulated conductor 14 is never exposed, it is impossible for a short to occur since the two terminals 16 never touch each other due to the nature of the design of the plug assembly 10. Large quantities of defectfree dual blade plug assemblies 10 can be assembled by this method with efficiency, reliability and relatively low cost.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An electrical terminal for mounting in a pre-formed channel in a plug housing, comprising:

(a) a crimp flange having a pair of upwardly directed opposite side portions and a bottom portion extending between and interconnecting said side portions;

(b) at least one insulation piercing knife integral with said crimp flange projecting from said bottom portion into the space between said side portions; and (c) a blade extending from said crimp flange for insertion into an electrical socket, said blade including a web portion connected to said crimp flange and a plurality of lance-formed barbs along said web portion for abutting against a wall of the pre-formed channel to resist removal of said electrical terminal from said plug housing.

2. The terminal of claim 1 wherein said at least one insulation piercing knife is a pair of insulation piercing knives cut out and bent upwardly from said bottom portion of said crimp flange.

3. The terminal of claim 2 wherein said insulation piercing knives are disposed substantially in a tandem alignment with one another.

4. An electrical plug assembly, comprising:

(a) a plug housing having opposite front and rear ends and defining a pair of spaced apart pre-formed channels therethrough open at each of said opposite ends thereof;

(b) a pair of insulated conductors each having an end and an electrical wire and a layer of insulation covering said wire and being disposed at least partially within one of said channels of said plug housing; and (c) a pair of electrical terminals each being insertable into one of said channels of said plug housing at the front end of said plug housing, each said terminal including:

(i) a crimp flange having a pair of upwardly directed opposite side portions and a concave arcuate-shaped bottom portion extending between and interconnecting said side portions;

(ii) at least one insulation piercing knife integral with said crimp flange projecting upwardly from said bottom portion into the space between said side portions; and (iii) a blade extending from said crimp flange for insertion into an external electrical socket for making an electrical connection.

5. The assembly of claim 4 wherein said housing is of a one-piece construction.

6. The assembly of claim 4 wherein each of said electrical terminals has a one-piece construction.

7. The assembly of claim 4 wherein:

each of said electrical terminals has opposite ends; and said crimp flange of each said electrical terminal is disposed at a rearward position on said electrical terminal adjacent to one of said opposite ends thereof.

8. The assembly of claim 7 wherein said blade of each of said electrical terminals is disposed at a forward position on said electrical terminal opposite from said crimp flange and adjacent to the other end of said opposite ends of said electrical terminal and extending therefrom toward but spaced from said one opposite end of said electrical terminal.

9. The assembly of claim 4 wherein said at least one insulation piercing knife of said electrical terminal is a pair of insulation piercing knives cut out and bent upwardly from said bottom portion of said crimp flange of said electrical terminal and disposed between said side portions of said crimp flange of said electrical terminal.

10. The terminal of claim 9 wherein said insulation piercing knives are disposed substantially in a tandem alignment with one another.

11. The terminal of claim 4 wherein said blade includes a web portion connected to said crimp flange having a plurality of undulations formed along opposite sides of said web portion so as to define lance-formed barbs capable of entering one of said channels from the front end of said plug housing and abutting a wall of said channel to prevent removal of said electrical terminal by being pulled back through said one channel after said insulated conductor end and said electrical terminal have been inserted into said one channel of said plug housing.

12. A method of making a plug assembly, said method comprising the steps of:

(a) providing a plug housing and a plurality of electrical terminals, each of the electrical terminals having a crimp flange, at least one insulation piercing knife connected to the crimp flange and a blade connected to the crimp flange for insertion into an external electrical socket, the crimp flange having a pair of upwardly directed opposite side portions and a bottom portion extending between and interconnecting the side portions, the knife extending upwardly from the bottom portion of the crimp flange and disposed between the side portions of the crimp flange such that the end of the insulated conductor can be placed between the side portions of the crimp flange and over the piercing knife whereupon prior to insertion of the electrical terminal into the respective one of the channels of the plug housing the crimp flange is crimped onto the insulated conductor end by bending the side portions of the crimp flange toward one another over and downwardly toward the insulated conductor end such that the side portions of the crimp flange press the insulated conductor end downwardly upon the piercing knife which pierces and displaces insulation of the insulated conductor end and makes an electrical connection with an electrical wire of the insulated conductor and such that after crimping the crimp flange the electrical terminal may be inserted into the channel of the plug housing at the one of opposite ends of the plug housing to a point spaced interiorly from the other of the opposite ends of the plug housing;

(b) passing a pair of insulated conductors through channels of the plug housing such that separate portions of each of the insulated conductors extend from opposite ends of the plug housing;

(c) aligning ends of the electrical terminals with the portions of the insulated conductors which extend from one of the opposite ends of the plug housing;

(d) crimping the electrical terminals on the ends of the insulated conductors such that insulation on the insulated conductors is penetrated and electrical connections are made between the electrical terminals and electrical wires within the ends of the insulated conductors; and (e) securing the crimped electrical terminals on the insulated conductor ends within the channels of the plug housing.

13. The method of claim 12 wherein said electrical terminal is provided with a pair of insulation piercing knives cutout and bent upwardly from the bottom portion of the crimp flange.

14. The method of claim 13 wherein said insulation piercing knives are provided substantially in a tandem alignment with one another.

15. The method of claim 12 wherein the blade of the electrical terminal is provided with a web portion connected to the crimp flange and having a plurality of undulations formed along opposite sides of the web portion so as to define lance-formed barbs which abut against the plug housing and prevent removal of the electrical terminal by being pulled back through the one channel and therefrom after the insulated conductor end and the electrical terminal have been inserted into the one channel of the plug housing.

16. The method of claim 12 wherein the terminals are provided with an interconnecting strip and the strip is removed concurrently with the crimping of the electrical terminals.

17. The method of claim 12 wherein the terminals are provided with an interconnecting strip and the strip is removed after the crimping of the electrical terminals.

18. The method of claim 12 wherein the terminals are provided with an interconnecting strip and the strip is removed before the crimping of the electrical terminals.

19. The terminal of claim 1 in which the bottom portion is concave shaped.

* * * * *